US005184333A

United States Patent [19]

Caspar

[11] Patent Number: 5,184,333

[45] Date of Patent: Feb. 2, 1993

[54] CLOCK MOVEMENT

[75] Inventor: Michel Caspar, Le Sentier, Switzerland

[73] Assignee: Montres Breguet S.A., Le Brassus, Switzerland

[21] Appl. No.: 860,978

[22] Filed: Mar. 31, 1992

[30] Foreign Application Priority Data

Apr. 17, 1991 [CH] Switzerland ..... 1151/91

[51] Int. Cl.[5] ..... G04B 19/24

[52] U.S. Cl. ..... 368/28

[58] Field of Search ..... 368/28, 35–38, 368/15–20

[56] References Cited

U.S. PATENT DOCUMENTS 3,940,859 3/1976 Troseth ..... 33/270
4,645,354 2/1987 Mercer ..... 368/15
5,023,849 6/1991 Vaucher ..... 368/15

*Primary Examiner*—Vit W. Miska
*Attorney, Agent, or Firm*—Ladas & Parry

[57] ABSTRACT

The clock movement comprises a perpetual calendar mechanism (1–15), an equation-of-time mechanism (16–19) and a third mechanism (20–23) which is actuated by the first so as to modify the angular position of an equation-of-time cam (16) of the second mechanism, as a function of the number of days in the months. Thus this cam (16) always performs exactly one complete revolution in one year, irrespective of the number of days in the year. The movement is therefore a perpetual calendar movement and a perpetual equation-of-time movement. It also has the advantage that, after it has been stopped for an indeterminate time, the exact angular position of the equation-of-time cam (16) is automatically restored, with no possibility of error, simply by bringing the date, year, month and time back into phase.

6 Claims, 2 Drawing Sheets

CLOCK MOVEMENT

FIELD OF THE INVENTION

The invention relates to a clock movement particularly to the association therein of a perpetual calendar mechanism with an equation of time mechanism.

BACKGROUND

Clock movements with a perpetual calendar are known. The purpose of these watches or clocks is automatically to give the date as well as the time. In very general terms, they are made to show the day, the month and the date according to the Gregorian calendar. Perpetual calendar watches automatically take into account the different lengths of the months and of leap years. The mechanisms of these perpetual calendar movements are based on the presence of a 48-tooth wheel which is actuated for changing the 48 months between two leap years. This wheel therefore performs one rotation in 4 years. Fixed to its upper surface is a cam divided into 48 steps; their arcs are equal but their depth varies according to the length of the month which they represent.

Clock movements with equation of time are also known. These equation-of-time watches or clocks possess a pair of hour and minute hands showing the mean or civil time, as in most watches. These watches also show the difference between the civil time and the true time, by means of an equation-of-time am.

SUMMARY OF THE INVENTION

The object of the invention is to provide a clock movement, with a perpetual calendar, which simultaneously shows the difference between the civil time and the true time. It is therefore a perpetual calendar movement according to the Gregorian calendar and a perpetual equation-of-time movement.

BRIEF DESCRIPTION OF THE FIGURES OF THE DRAWING

An embodiment of the movement according to the invention is illustrated in the attached drawings by way of example.

DETAILED DESCRIPTION OF A PREFERRED EMBODIMENT

Figure 1:
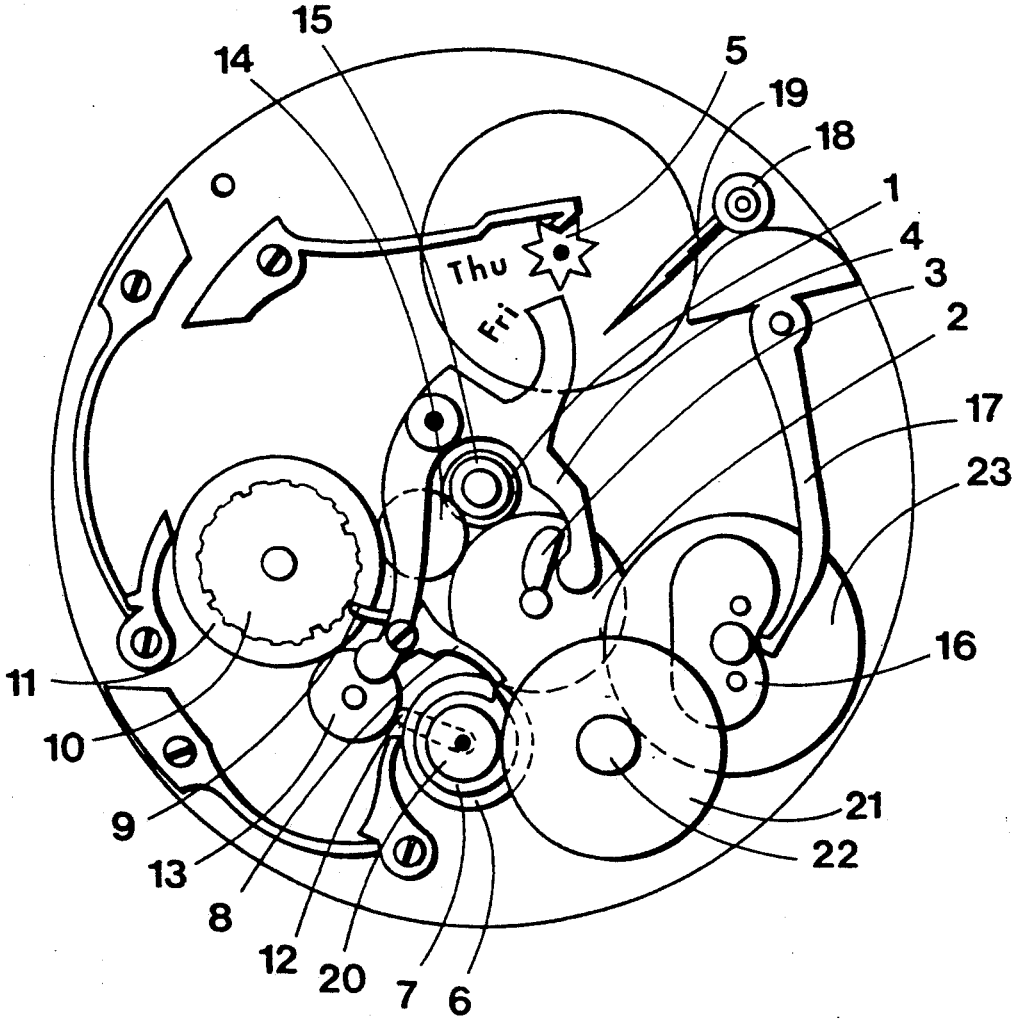
FIG. 1 is a diagrammatic view of the movement.

The movement illustrated in FIG. 1 comprises three mechanisms, the first including a perpetual calendar, the second an equation of time and the third—an essential part of the invention—which functionally links the perpetual calendar mechanism with the equation-of-time mechanism so that both the civil time and the difference between the civil time and the true time are displayed simultaneously and perpetually on the dial.

The first mechanism comprises, at the center of the movement, an hour wheel 1 meshing with a 24-hour wheel 2 carrying a driving pin 3 for lifting a perpetual multiple rocker 4 once every 24 hours. At the moment when the rocker 4 is lifted, a nose on the rocker rotates by one tooth a 7-tooth star wheel 5 showing the days of the week, and simultaneously rotates the 31-tooth date wheel 6. The date wheel 6 is angularly integral with a spiral 7. The multiple rocker 4 has a ratchet 8 cooperating with the spiral 7, and a lever arm 9 cooperating with the steps on a cam 10 divided into 48 steps, the depths of which vary according to the length of the months which they represent. This cam 10 is angularly integral with a 48-tooth wheel 11. The ratchet 8 slides over the periphery of the spiral 7 without producing any effect until the lever arm 9 is resting on the step corresponding to the 16 months of 30 days, the 3 months of 28 days or Feb. 29 of the leap year. At this moment the tip of the ratchet 8 meshes with the notch in the spiral 7. The ratchet 8 then drives the additional teeth and passes to the first day of the next month. An end-of-month pin 12 then drives the intermediate gear wheel 13, which in turn will advance the 48-month wheel 11 by one tooth integrally with the 48-month cam 10, which itself will drive an intermediate gear wheel of the 12-month indicator 14 and, consequently, the 12-month wheel 15. By virtue of this mechanism, the 31-tooth date wheel 6 performs one 360° rotation, irrespective of the number of days in the month.

The second mechanism comprises an equation-of-time cam 16 with which a feeler 17 cooperates; said feeler is integral with a toothed quadrant which actuates a gear wheel 18 carrying a hand 19 showing the momentary difference between the civil time and the true time. The cam 16 is rotated by the clock mechanism.

The third mechanism comprises a series of gear wheels and other wheels linking the date wheel 6 to the equation-of-time cam 16. A 16-tooth gear wheel 20, which is angularly integral with the date wheel 6, meshes with a 48-tooth wheel 21. A 14-tooth transmission gear wheel 22, which is integral with the wheel 21, meshes with a 56-tooth wheel 23 which is angularly integral with the equation-of-time cam 16. Consequently the gear wheel 20, integral with 12, 6 and 7, will perform one rotation per month, irrespective of the current year or the number of days in the corresponding month.

The fact that the equation of time is perpetual can be demonstrated in the following way. Considering that the transmission for the display of the equation of time is effected by the 16-tooth gear wheel 20, the 48-tooth wheel 21, the 14-tooth gear wheel 22 and the 56-tooth wheel 23 carrying the equation cam 16, the following formula can be put forward:

$$\frac{(20)\ 16 \times (22)\ 14 = 1}{\underline{\underline{(21)\ 48}} \times \underline{\underline{(23)\ 56}} = 4}$$
$$3 \times 4 = 12$$

Thus it is demonstrated that the equation of time is shown perpetually, in the horological sense of the word. This implies that, irrespective of the current year, the 56-tooth wheel 23 carrying the equation cam 16 will perform one 360° rotation. The true time is therefore displayed perpetually with the greatest precision.

Figure 2:
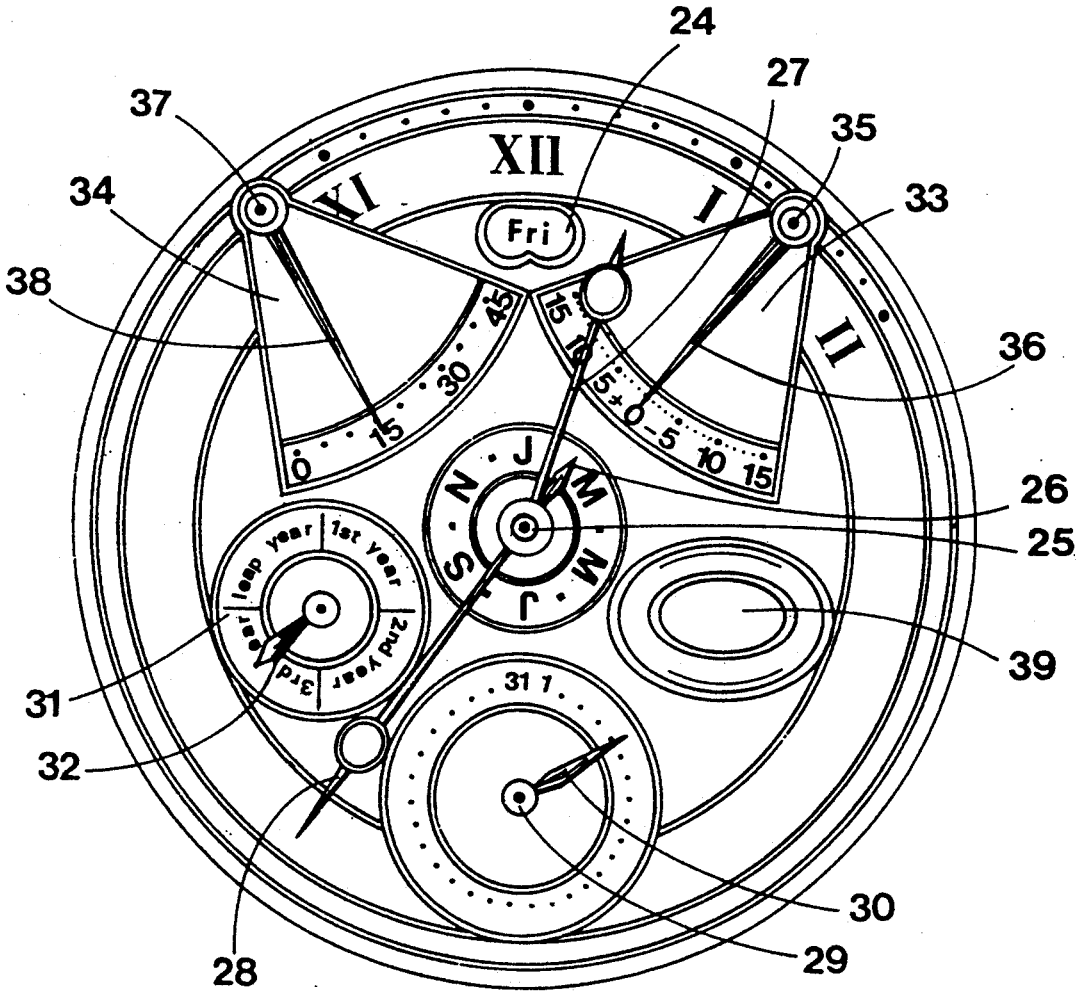
FIG. 2 is a view of the dial.

FIG. 2 illustrates an example of the dial of an automatic wristwatch provided with the movement illustrated in FIG. 1.

It can be seen in FIG. 2 that the middle of the window 24 displaying the day of the week, the center of rotation 25 of the hand 26 showing the months, which coincides with the center of rotation 25 of the time hands 27 and 28, and the center of rotation 29 of a hand 30 showing the date are situated on the median line of the dial. In an auxiliary dial 31 located on the left-hand side of the dial, a hand 32 shows the current year in relation to the leap year. There are also two graduated quadrants 33 and 34 located symmetrically on either side of the median line of the dial in its upper part. The quadrant 33 comprises a 62° arc of a circle, the center 35 of which is fitted with a hand 36 showing the positive or negative variation of the true time in minutes relative to the civil time shown by the hour hand 27 and minute hand 28, the center of rotation of which is located at 25. The quadrant 34 comprises a 60° arc of a circle, the center 37 of which is fitted with a hand 38 showing the period which the automatic movement has left to run. 39 indicates the position of a trade mark, completing the symmetry of the dial.

The clock movement of the invention is advantageous because, after the movement has been stopped for an indeterminate time, the equation cam can automatically be restored to the exact position, with no possibility of error, simply by bringing the date, year, month and time back into phase.

What is claimed is:

1. A clock movement comprising a first perpetual calendar mechanism and a second equation-of-time mechanism, said movement further comprising a third mechanism including means, cooperating with said perpetual calendar mechanism and said equation-of-time mechanism, for perpetually displaying the difference between the civil time, displayed by the first mechanism, and the true time.

2. A movement according to claim 1 wherein said equation-of-time mechanism comprises an equation-of-time cam, said third mechanism being actuated by the first mechanism so as to modify the angular position of said equation-of-time cam, as a function of the number of days in the month, so that said cam always performs one complete revolution in one year, irrespective of the number of days in the year.

3. A movement according to claim 2 wherein said third mechanism comprises a gear wheel, which is angularly integral with a date wheel of said first mechanism, and a 48-tooth wheel which meshes with said gear wheel and is integral with a 14-tooth transmission gear wheel, itself meshing with a 56-tooth wheel which is angularly integral with said equation-of-time cam.

4. A movement according to claim 1, comprising a dial face have a median line, a window in said dial face through which the day of the week is displayed, said window being centered on said median line, a display hand for the month having a center of rotation, hour and minute hands have a common center of rotation coincident with the center of rotation of the display hand for the month, said coincident centers of rotation being on said median line and a date hand having a center of rotation on said median line.

5. A movement according to claim 4, comprising two graduated quadrants located symmetrically on opposite sides of said median line including respective hands relating the difference between civil time and true time and period of time remaining for automatic operation of said movement.

6. A movement according to claim 5, comprising an auxiliary dial offset from said median line for display of the current year in relation to the next leap year.

* * * * *